US007627975B1

(12) United States Patent
Hines

(10) Patent No.: US 7,627,975 B1
(45) Date of Patent: Dec. 8, 2009

(54) ELECTRIFIED HANDGUARD

(76) Inventor: Steve Hines, P.O. Box 423, Tijeras, NM (US) 87059

( * ) Notice: Subject to any disclaimer, the term of this patent is extended or adjusted under 35 U.S.C. 154(b) by 536 days.

(21) Appl. No.: 11/706,666

(22) Filed: Feb. 12, 2007

(51) Int. Cl.
*F41C 27/00* (2006.01)

(52) U.S. Cl. ..... 42/84

(58) Field of Classification Search ..... 42/84, 42/90

See application file for complete search history.

(56) References Cited

U.S. PATENT DOCUMENTS

| | | | | | |
|---|---|---|---|---|---|
| 1,215,171 | A * | 2/1917 | Lewis | 356/247 |
| 1,993,979 | A * | 3/1935 | Reed | 362/113 |
| 2,093,514 | A * | 9/1937 | Cornett et al. | 362/114 |
| 2,912,566 | A * | 11/1959 | Cornett | 362/110 |
| 5,237,773 | A * | 8/1993 | Claridge | 42/117 |
| 5,799,433 | A * | 9/1998 | Danner et al. | 42/1.05 |
| 5,826,363 | A | 10/1998 | Olson | 42/75.01 |
| 6,792,711 | B2 | 9/2004 | Battaglia | 42/114 |
| 7,036,261 | B2 * | 5/2006 | Murello | 42/127 |
| 7,117,624 | B2 | 10/2006 | Kim | 42/85 |
| 7,401,434 | B2 * | 7/2008 | Murello | 42/127 |
| 2002/0083634 | A1 * | 7/2002 | Kim et al. | 42/123 |
| 2002/0100204 | A1 * | 8/2002 | Kim | 42/146 |
| 2006/0207155 | A1 * | 9/2006 | Murello | 42/124 |

OTHER PUBLICATIONS

Military Standard, Dimensioning of Accessory Mounting Rail for Small Arms Weapons, MIL-STD-1913 Notice 1, Jun. 10, 1999.
Military Standard, Dimensioning of Accessory Mounting Rail for Small Arms Weapons, MIL-STD-1913 (AR), Feb. 3, 1995.

* cited by examiner

*Primary Examiner*—Michael Carone
*Assistant Examiner*—Reginald Tillman, Jr.
(74) *Attorney, Agent, or Firm*—Richard H. Krukar; Luis M. Ortiz; Kermit D. Lopez

(57) ABSTRACT

An electrified handguard for firearms has mounting rails and also supplies electrical power to rail mounted accessories such as flashlights and lasers. A handguard power coupler can receive electrical power from a battery or other power source located elsewhere such as in a buttstock assembly. The electrical power is then routed to power connections in the handguard power coupler. A rail accessory can then be electrically connected to a power connection when it is mechanically attached to a mounting rail.

20 Claims, 6 Drawing Sheets

ELECTRIFIED HANDGUARD

TECHNICAL FIELD

Embodiments relate to the fields of small arms, rifle handguards, carbine handguards, mounting rails, and electric small arms accessories. Embodiments also relate to electrical interconnects, electrical circuits, electrical contacts, and electrical sub assemblies.

BACKGROUND

Current small arms use mounting rail systems for attaching accessories to the small arm. For example, M4 and M16 carbines are often fitted with handguards that incorporate up to four Picatinny rails. Picatinny rails are well known mounting rails that meet the specifications contained in MIL-STD-1913 and MIL-STD-1913 Notice 1. Another mounting rail called the Weaver rail is a notoriously well known variation of the Picatinny rail. Battaglia discloses a mounting rail system in U.S. Pat. No. 6,792,711 while Olson discloses another in U.S. Pat. No. 5,826,363.

A number of accessories have been developed to attach to small arms by way of mounting rails. Kim discloses a rail mounted laser in U.S. Pat. No. 7,117,624. Rail mounted flashlights are also in common use. Current art laser accessories are similar to laser pointers in that they contain a laser, lens, and batteries within a housing. The housing is adapted to attach to a mounting rail such as the Picatinny rail or Weaver rail. Rail mounted flashlights are also common and contain a broad band light source, lens, and batteries within a rail mountable housing.

Toy replica firearms such as Airsoft toys are pellet firing small arms replicas. Hobbyists enjoy engaging in mock non-lethal battles using toy replica firearms because they are realistic looking and fire non lethal, although often painful, pellets. The realistic toys are also used in small arms training because the toys can have the same weight, size, and accessories as firearms used in combat or police work. The toy replica firearms are often realistic enough that many after market accessories can be used with both small arms and with toy replica firearms. Toy replica firearms, however, often use electric motors to pressurize air that is then used to propel pellets. The electric motor is commonly powered by batteries that are located in the rifle butt, the pistol grip, or the handguard. Those practiced in combat training and police training are familiar with toy replicas.

Some firearms and toy replica firearms have handguards incorporating four Picatinny rails to which four or more accessories can be attached. The result is a front heavy firearm that is difficult to balance and slow to point. As such, systems and methods are needed to address shortcomings in the prior art.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods providing an electrified handguard that reduces the need for locating power sources, such as batteries, near the handguard are needed.

It is therefore an aspect of the embodiments to provide a handguard power coupler that has a handguard power input and power connections. In one embodiment, the handguard power coupling can be attached to a handguard. In another embodiment, the handguard incorporates the handguard power coupling. Rail accessories, such as lasers and flashlights, can be attached to mounting rails that are part of the handguard. The handguard power coupling can obtain power from a power source and the rail accessories can obtain electrical power from the handguard power coupling.

DETAILED DESCRIPTION

An electrified handguard for firearms has mounting rails and also supplies electrical power to rail mounted accessories such as flashlights and lasers. A handguard power coupler can receive electrical power from a battery or other power source located elsewhere such as in a buttstock assembly. The electrical power is then routed to power connections in the handguard power coupler. A rail accessory can then be electrically connected to a power connection when it is mechanically attached to a mounting rail.

Figure 1:
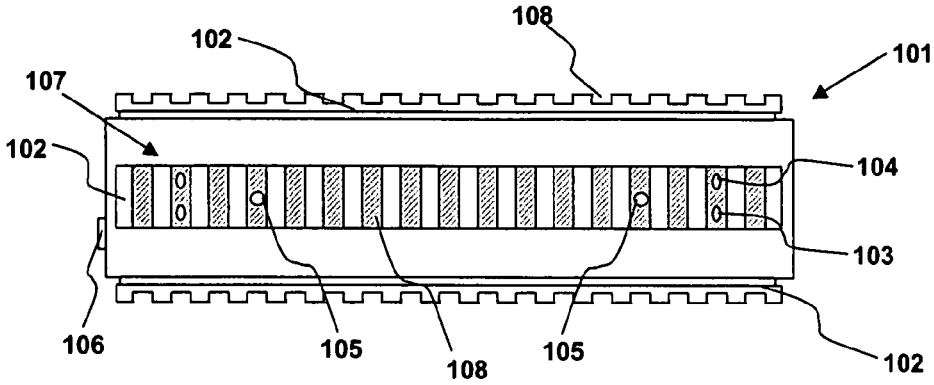
FIG. 1 illustrates a handguard in accordance with aspects of the embodiments.

FIG. 1 illustrates a handguard 101 in accordance with aspects of the embodiments. The handguard is illustrated as having four powered mounting rails 102 of which three are visible. Each powered mounting rail 102 has recoil grooves 108 that help fix accessories in position. Mounting rail power connections 107 are located within the recoil grooves 108 and have a positive electrical contact 103 and a negative electrical contact 104. The handguard is wired to receive electrical power from a handguard power input 106 and to pass the power to the mounting rail power connections 107. The illustrated handguard power input 106 is a simple plug receptacle such that a power plug can be plugged into it. Those practiced in the art of electrical subassemblies are familiar with plugs, plug receptacles, conductive fingers, and other means of passing electrical power from one subassembly to another.

Two bolts 105 are shown attaching the mounting rail 102 to the handguard 101. As such, the mounting rail 102 is detachable because removing the bolts allow the mounting rail to be removed from the handguard 101. Detachable mounting rails are not critical to the embodiments because some embodiments have permanent mounting rails that are not detachable.

Figure 2:
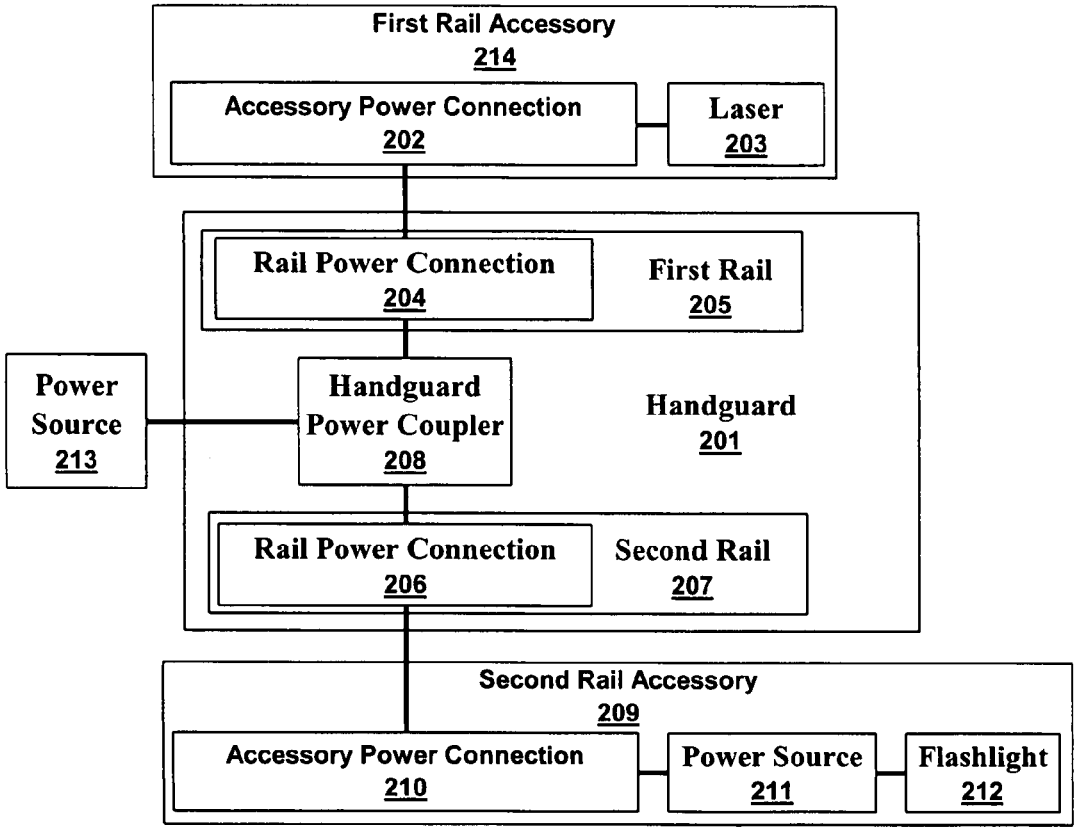
FIG. 2 illustrates a high level block diagram of rail accessories attached to a handguard in accordance with aspects of the embodiments.

FIG. 2 illustrates a high level block diagram of rail accessories attached to a handguard 201 in accordance with aspects of the embodiments. The first rail accessory 214 is a laser accessory that has a laser 203 receiving power from an accessory power connection 202. The second rail accessory 209 is a flashlight accessory that has a flashlight 212 receiving power from a power source 211, such as a battery, and from an accessory power connection 210. The accessory power connections 202, 210 are electrically connected to rail power connections 204, 206 located on a first rail 205 and a second rail 207. An electrical interconnect within the electrified handguard 201 electrically connects the mounting rail power connections 204, 206 to each other and to a handguard power coupler 208.

A power source 213 connected to the handguard power coupler 208 can supply power to the first rail accessory 214 and to the second rail accessory 209. Furthermore, the power source 211 in the second rail accessory 209 can power the first rail accessory 214 and can be recharged from the external power source 213.

Figure 3:
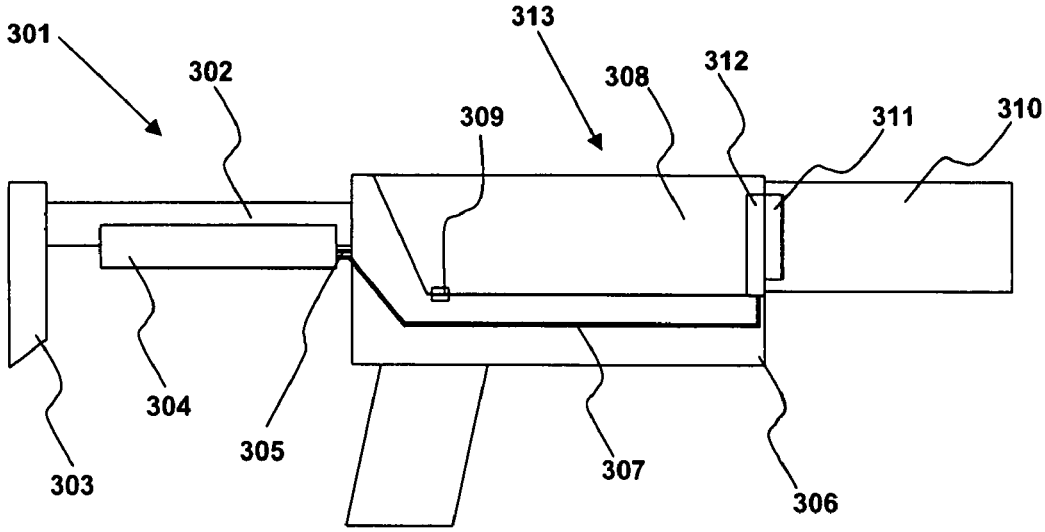
FIG. 3 illustrates small arms elements including a handguard in accordance with aspects of the embodiments.

FIG. 3 illustrates small arms elements including a handguard 310 in accordance with aspects of the embodiments. The buttstock assembly 301 has a tube 302, butt 303, and container 304. The container 304 contains a power source electrically connected by wires 305 to a receiver 313. The receiver 313 is typical of an M16 or M4 receiver in having an aluminum upper receiver 308 and an aluminum lower receiver 306. Aluminum is electrically conductive. The wires 305 connect the negative power source terminal to the lower receiver 306 and the positive power source terminal to an insulated wire 307. The lower receiver 306 is electrically connected to the upper receiver 308 by conductive fingers 309. Those practiced in the art of electronics enclosures are familiar with conductive fingers 309.

In FIG. 3, electrical power passes through the receiver along two conductive pathways. One conductive pathway is the wire 307 while the second is formed by the conductive receiver elements. A second wire can be used instead of the conductive receiver elements.

After passing through the receiver 313, the electrical power reaches a first inductor 312 that is inductively coupled to a second inductor 311. The second inductor is the handguard power input for the handguard 310. A gun barrel or other ferromagnetic element passing through the center of the inductors can increase coupling efficiency. Inductive coupling requires alternating current. Those practiced in the art of electronics are familiar with circuits, such as inverters and rectifiers, for converting between alternating current and direct current.

Figure 4:
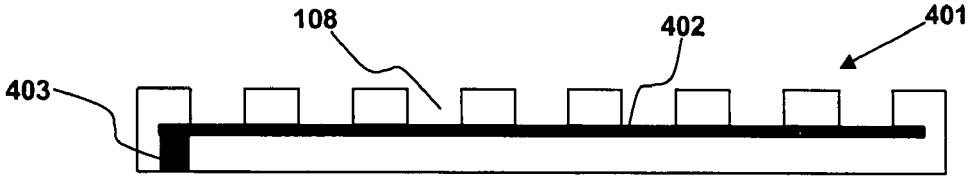
FIG. 4 illustrates a side view of a mounting rail with power rails in accordance with aspects of the embodiments.

FIG. 4 illustrates a side view of a powered mounting rail 401 with power rails 402 in accordance with aspects of the embodiments. The power rails 402 run along the outside edge of the powered mounting rail 401. A rail power input 403 is used to electrically connect a power rail 402 to the handguard's electrical interconnect. The power rails 402 form the rail power connection from which rail accessories draw electrical power.

Figure 5:
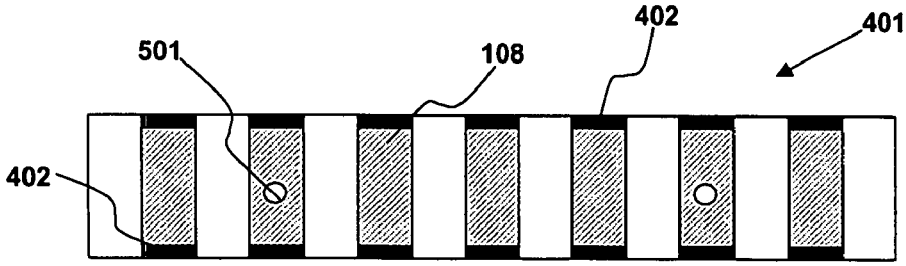
FIG. 5 illustrates a top view of a mounting rail with power rails in accordance with aspects of the embodiments.

FIG. 5 illustrates a top view of a mounting rail 401 with power rails 402 in accordance with aspects of the embodiments. The power rails 402 are accessible along the edges of the recoil grooves 108. A bolt hole 501 can be used for attaching a detachable mounting rail 401 to a handguard.

Figure 6:
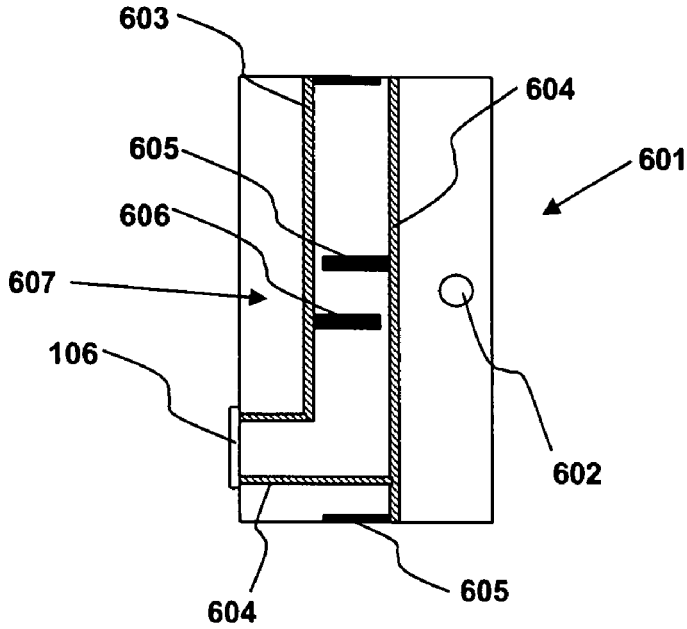
FIG. 6 illustrates a handguard power coupler with electrical interconnects in accordance with aspects of the embodiments.

FIG. 6 illustrates a handguard power coupler 601 with electrical interconnects in accordance with aspects of the embodiments. A handguard power input 106 couples power into a positive trace 603 and into a negative trace 604. A handguard power connection 607 has a negative terminal 605 electrically connected to the negative trace 604 and a positive terminal 606 electrically connected to the positive trace 603. The traces 603, 604 are insulated.

Embodiments using a conductive material such as aluminum or conductive plastic for the body of the electrified handguard can use only one trace because the body can act as the second trace. A threaded bolt hole 602 can act as the associated positive or negative terminal.

Figure 7:
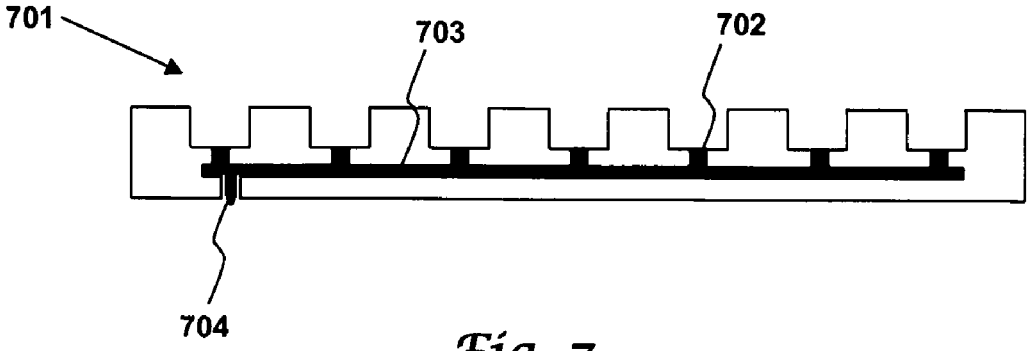
FIG. 7 illustrates a cut view of a mounting rail with electrical contacts in the recoil grooves in accordance with aspects of the embodiments.

The handguard power coupler of FIG. 6 is designed for use with powered mounting rails such as that of FIG. 7. Handguard power couplers for use with non-powered rails have a slightly different design.

FIG. 7 illustrates a cut side view of a mounting rail 701 with electrical contacts 702 in the recoil grooves in accordance with aspects of the embodiments. The mounting rail 701 is similar to the mounting rails 102 of FIG. 1. As such the electrical contacts 702 correspond to the electrical contacts 103, 104 of FIG. 1. The electrical contacts 702 are electrically connected to each other and to a contact spring 704 by a power bus 703. Those practiced in the art of electrical interconnects are familiar with contact springs. The contact spring 704 can press against one of the terminals of FIG. 6 to conduct power into the mounting rail 701.

Figure 8:
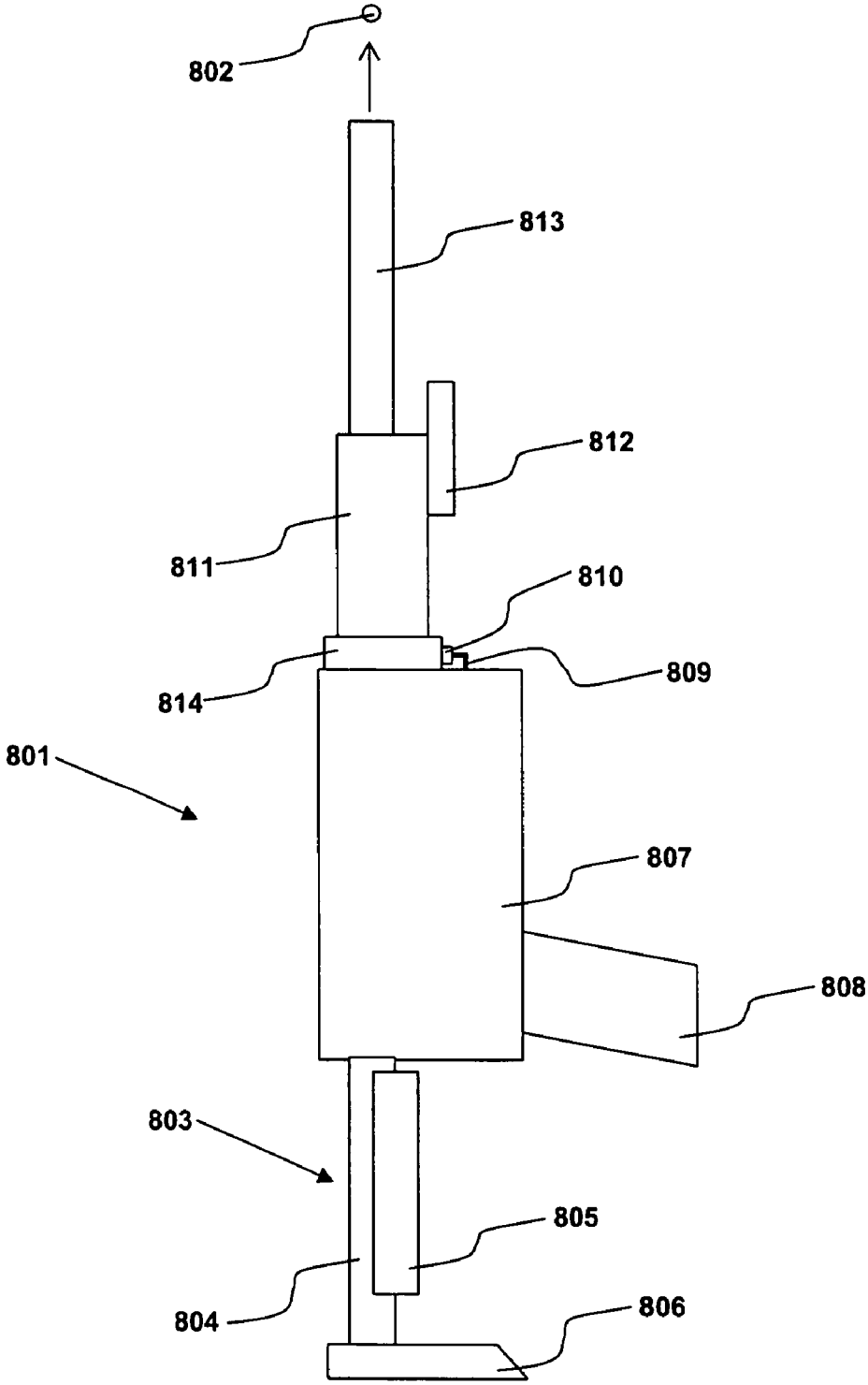
FIG. 8 illustrates an idealized toy replica firearm with an electrified handguard in accordance with aspects of the embodiments.

FIG. 8 illustrates an idealized toy replica firearm 801 with a handguard 811 in accordance with aspects of the embodiments. The replica has a buttstock assembly 803 with a butt 806, tube 804, and container 805. The tube 803 and a pistol grip 808 are connected to a receiver 807. Batteries are commonly held within the receiver 807 or within the pistol grip 808. Wires 809 can conduct electrical power from the batteries to the handguard power input 810 of a handguard power coupler 814. A laser accessory 812 is attached to the handguard 811 and receives power from the batteries. A pellet 802 is shown being shot out of the barrel 813.

Figure 9:
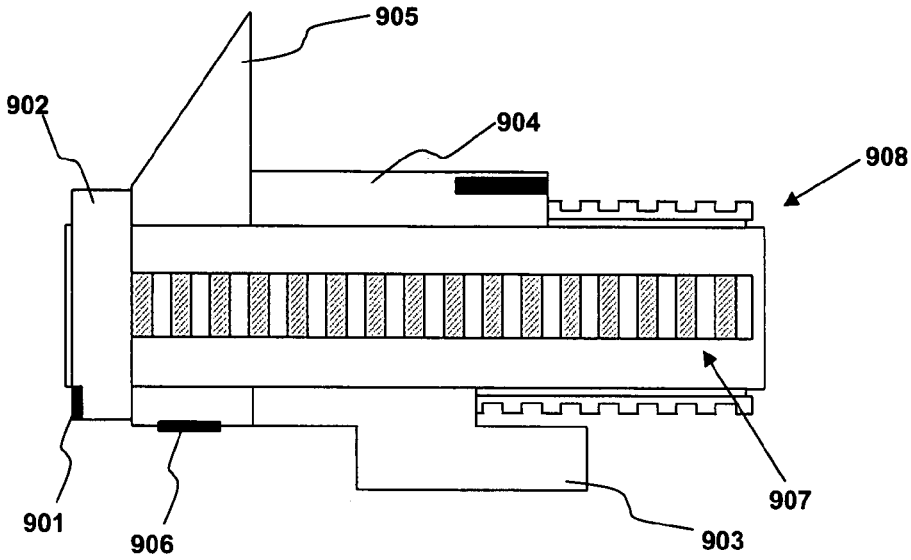
FIG. 9 illustrates a handguard with accessories and non-powered mounting rails in accordance with aspects of the embodiments.

FIG. 9 illustrates a handguard 908 with accessories and non-powered mounting rails 907 in accordance with aspects of the embodiments. A handguard power coupler 902 is attached to the mounting rails 907 and receives electrical power through a handguard power input 901. The handguard power coupler 902 passes the electrical power to power connections. Rail accessories, such as a switch accessory 906, flashlight accessory 903, laser accessory 904 and extension accessory 905 can plug into the power connections and thereby be energized.

The flashlight accessory 903 is plugged into the switch accessory 906 which is plugged into the handguard power coupler 902. The laser accessory 904 is plugged into the extension accessory 905 which is plugged into the power coupler. The switch accessory 906 is used to control the flow of electrical power. The extension accessory 905 is used to change the laser accessory position on the mounting rail while still supplying power. The extension accessory 905 is illustrated as also providing a front sight for the rifle.

Figure 10:
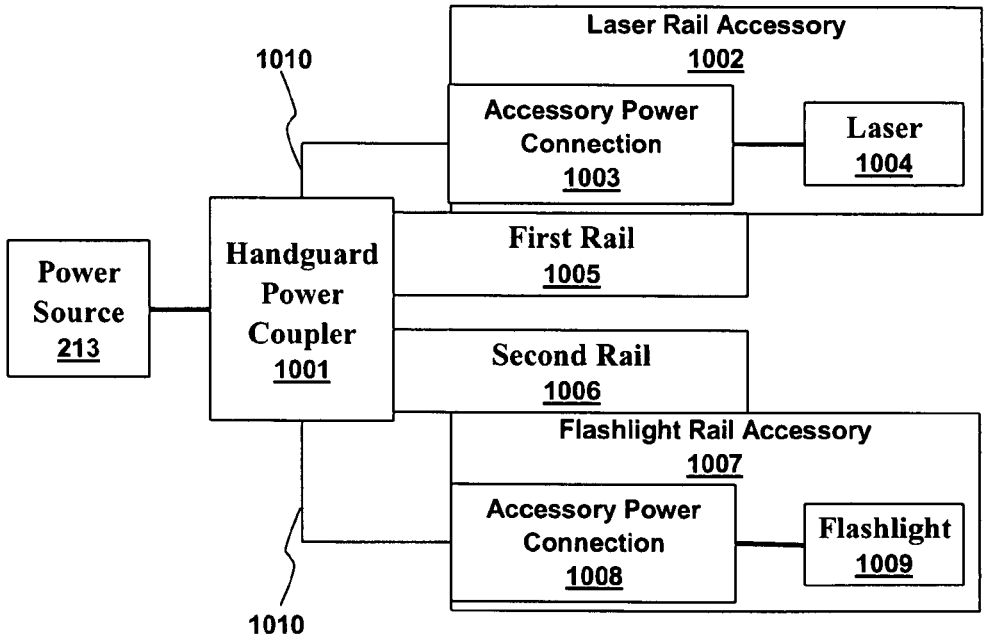
FIG. 10 illustrates a high level block diagram of a handguard with accessories and non-powered mounting rails in accordance with aspects of the embodiments.

FIG. 10 illustrates a high level block diagram of a handguard with accessories and non-powered mounting rails in accordance with aspects of the embodiments. A power source 213 supplies power to the handguard power coupler 1001. The electrical power passes through power connections 1010 to accessory power connections 1003, 1008. The laser rail accessory 1002 is attached to the first rail 1005 and uses the power to light a laser 1004. The flashlight rail accessory 1007 is attached to the second rail 1006 and uses the power to light a flashlight 1009.

Figure 11:
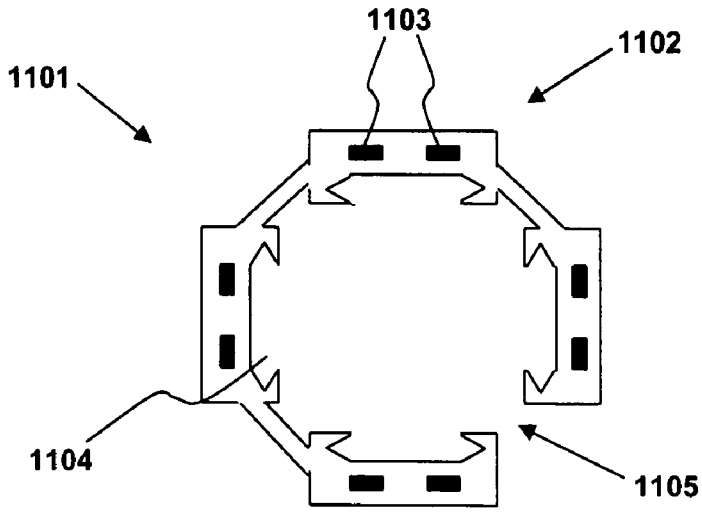
FIG. 11 illustrates a handguard power coupler for use with non-powered mounting rails in accordance with aspects of the embodiments.

FIG. 11 illustrates a handguard power coupler 1101 for use with non-powered mounting rails in accordance with aspects of the embodiments. This particular handguard power coupler 1101 attaches to four mounting rails, such as those of the handguard of FIG. 9. In practice, power couplers can attach to any number of handguards. A power section 1102 is attached to each of the four mounting rails. A power connection has electrical contacts 1103 that conduct electrical power. A plug and socket design is illustrated for these particular power connections. As illustrated, each power section 1102 has a Picatinny mating profile 1104 such that the handguard power coupler 1101 can be easily and solidly attached to Picatinny or Weaver mounting rails. The power coupler 1101 also has a gap 1105 indicating that it can be wrapped around a handguard and then each power section 1102 pressed into place. Nonflexible handguard power couplers, which need no gap 1105, can be slid onto the rails and down the handguard instead.

Figure 12:
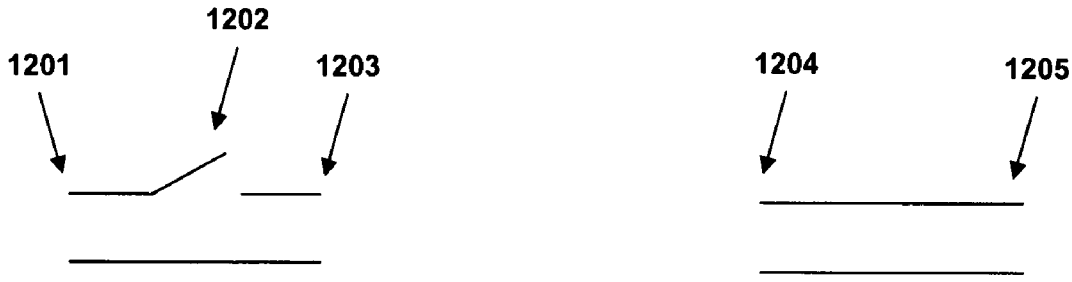
FIG. 12 illustrates circuit diagrams for the circuits in a switch accessory and an extension accessory.

FIG. 12 illustrates circuit diagrams for the circuits in a switch accessory and an extension accessory. The switch accessory has a switch input 1201, power switch 1202, and a switch output 1203. The extension has a power input 1204 and a power output 1205. As discussed above, the inputs 1201, 1204 can be plugs while the outputs 1203, 1205 can be sockets. Any of the numerous equivalent electrical connection types and arrangements can be used.

What is claimed is:

1. A firearm system comprising:

a handguard power coupler comprising a handguard power input and at least one power connection;

a handguard comprising at least one powered mounting rail comprising at least one rail power connection;

wherein a power source electrically connected to the handguard power input is also electrically connected to the at least one rail power connection; and wherein a rail accessory attached to the at least one mounting rail receives electrical power from the power source.

2. The system of claim 1 further comprising a power switch for controlling the flow of electrical power from the power source to the rail accessory.

3. The system of claim 1 wherein the at least one powered mounting rail is a detachable mounting rail.

4. The system of claim 1 wherein the at least one powered mounting rail is dimensioned as a Picatinny rail.

5. The system of claim 1 further comprising a first rail accessory mechanically connected to the at least one powered mounting rail and electrically connected to the at least one rail power connection.

6. The system of claim 1 further comprising:

a first rail accessory mechanically connected to the at least one powered mounting rail and electrically connected to the at least one rail power connection;

a second rail accessory mechanically connected to the at least one powered mounting rail and electrically connected to the at least one rail power connection;

wherein the second rail accessory comprises a power source; and wherein the second rail accessory provides power to the first rail accessory.

7. The system of claim 1 wherein a toy replica firearm comprises the handguard.

8. A firearm system comprising:

a handguard power coupler comprising a handguard power input and at least one power connection;

wherein a handguard comprises at least one mounting rail;

wherein the handguard power coupler attaches to the at least one mounting rail;

wherein a power source electrically connected to the handguard power input is also electrically connected to the at least one power connection;

wherein a rail accessory attached to the at least one mounting rail receives electrical power from the power source.

9. The system of claim 8 further comprising:

a switch accessory comprising a power switch, a switch input and a switch output;

wherein the switch accessory mechanically attaches to the mounting rail;

wherein the switch input electrically connects to the power source;

wherein the switch output electrically connects to the rail accessory; and wherein the power switch controls the flow of electrical power from the switch input to the switch output.

10. The system of claim 1 wherein the at least one mounting rail is dimensioned as a Picatinny rail.

11. The system of claim 8 further comprising a first rail accessory mechanically connected to the at least one mounting rail and electrically connected to the at least one power connection.

12. The system of claim 8 further comprising:

a first rail accessory mechanically connected to the at least one mounting rail and electrically connected to the at least one power connection;

a second rail accessory mechanically connected to the at least one mounting rail and electrically connected to the at least one power connection;

wherein the second rail accessory comprises a power source; and wherein the second rail accessory provides power to the first rail accessory.

13. The system of claim 8 wherein a toy replica firearm comprises the handguard.

14. A firearm system comprising:

a receiver comprising at least two electrically conductive pathways wherein at least one of the at least two electrically conductive pathways is insulated from the rest of the at least two electrically conductive pathways;

a power source electrically connected to the at least two electrically conductive pathways;

a handguard comprising at least one mounting rail;

a handguard power coupler comprising a handguard power input and at least one power connection; and wherein the at least two electrically conductive pathways electrically connect the handguard power input to the firearm power source.

15. The system of claim 14 further comprising a butt stock assembly wherein the buttstock assembly comprises the power source.

16. The system of claim 14 wherein the at least one mounting rail is a detachable mounting rail.

17. The system of claim 14 wherein the at least on mounting rail is dimensioned as a Picatinny rail or a weaver rail.

18. The system of claim 14 further comprising a rail accessory mechanically connected to the at least one mounting rail and electrically connected to the handguard power coupler.

19. The system of claim 14 wherein a toy replica firearm comprises the receiver and handguard.

20. The system of claim 14 further comprising:

a first rail accessory mechanically connected to the at least one mounting rail and electrically connected to the handguard power coupler;

a second rail accessory mechanically connected to the at least one mounting rail and electrically connected to the handguard power coupler;

wherein the second rail accessory comprises a power source; and wherein the second rail accessory provides power to the first rail accessory.

* * * * *

US007627975C1

(12) EX PARTE REEXAMINATION CERTIFICATE (9295th)

United States Patent
Hines

(10) Number: US 7,627,975 C1
(45) Certificate Issued: Sep. 11, 2012

(54) ELECTRIFIED HANDGUARD

(76) Inventor: Steve Hines, Tijeras, NM (US)

Reexamination Request:
No. 90/011,716, Jul. 6, 2011

Reexamination Certificate for:

| | |
|---|---|
| Patent No.: | **7,627,975** |
| Issued: | **Dec. 8, 2009** |
| Appl. No.: | **11/706,666** |
| Filed: | **Feb. 12, 2007** |

(51) Int. Cl.
*F41C 27/00* (2006.01)

(52) U.S. Cl. ..... 42/84
(58) Field of Classification Search ..... 42/84, 42/90; 446/473
See application file for complete search history.

(56) References Cited

To view the complete listing of prior art documents cited during the proceeding for Reexamination Control Number 90/011,716, please refer to the USPTO's public Patent Application Information Retrieval (PAIR) system under the Display References tab.

*Primary Examiner*—Jimmy G Foster

(57) ABSTRACT

An electrified handguard for firearms has mounting rails and also supplies electrical power to rail mounted accessories such as flashlights and lasers. A handguard power coupler can receive electrical power from a battery or other power source located elsewhere such as in a buttstock assembly. The electrical power is then routed to power connections in the handguard power coupler. A rail accessory can then be electrically connected to a power connection when it is mechanically attached to a mounting rail.

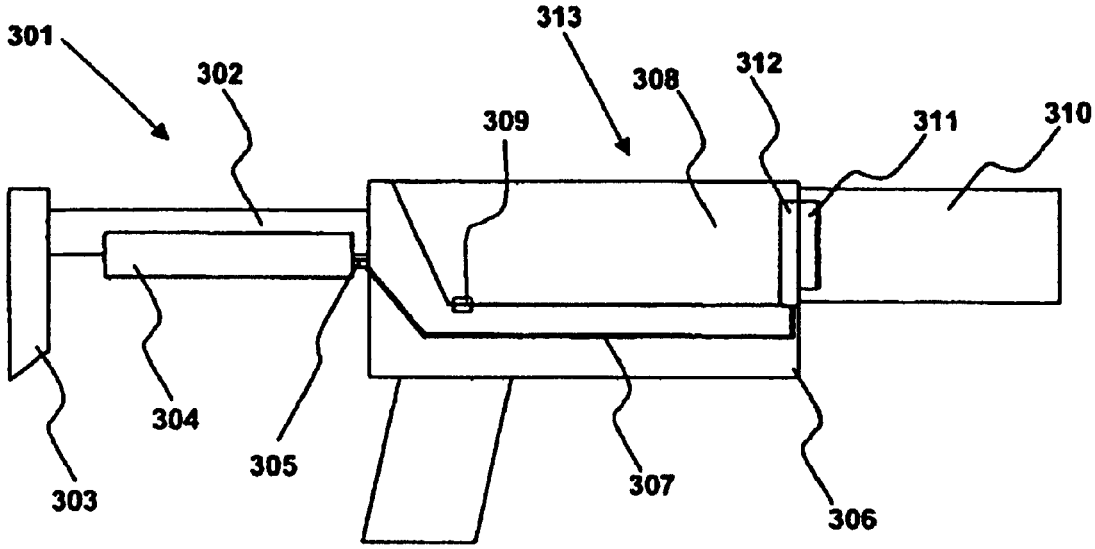

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-5, 7-11 and 13-19 is confirmed.

Claims 6, 12 and 20 are cancelled.

* * * * *